United States Patent [19]

Holder

[11] Patent Number: 5,067,237

[45] Date of Patent: Nov. 26, 1991

[54] BATTERING RAM

[76] Inventor: Michael D. Holder, 244 Monterrey, Hewitt, Tex. 76643

[21] Appl. No.: 642,533

[22] Filed: Jan. 17, 1991

[51] Int. Cl.[5] ..... B21C 1/00

[52] U.S. Cl. ..... 30/1; 72/325; 294/61; 294/97

[58] Field of Search ..... 30/1, 366; 294/61, 97, 294/126–128; 173/90, 126; 72/325, 705; 7/144, 161; 29/426.1, 426.2, 426.4, 426.5, 426.6

[56] References Cited

U.S. PATENT DOCUMENTS

| | | | |
|---|---|---|---|
| 95,012 | 9/1869 | Fenn | 294/127 |
| 845,445 | 2/1907 | Alvord | 294/127 |
| 2,789,856 | 4/1957 | Russell | 294/61 |
| 3,222,915 | 12/1965 | Swisher . | |
| 3,570,289 | 3/1971 | Smyers . | |
| 4,122,699 | 10/1978 | Logsdon . | |
| 4,231,247 | 11/1980 | Haydon . | |
| 4,577,899 | 3/1986 | Hemingway | 294/97 X |
| 4,657,225 | 4/1987 | Hoehn et al. . | |
| 4,681,171 | 7/1987 | Kee et al. . | |
| 4,783,053 | 11/1988 | Yirmiyahu et al. . | |

*Primary Examiner*—Douglas D. Watts
*Attorney, Agent, or Firm*—James E. Bradley

[57] ABSTRACT

A battering ram for forcible entry through a door has a pointed end with barbs to enable the door to be hooked and pulled outward. The barbs will swing between contracted and expanded positions. This spring biases the barbs to the expanded position. The barbs are conical and define a cone with the same taper as the pointed tip when the barbs are collapsed. One end of the battering ram may have a loop for attaching to a line connected to a vehicle. Also, one end of the battering ram may have a battering plate or may have a bar for prying burglar bars outward.

20 Claims, 2 Drawing Sheets

BATTERING RAM

BACKGROUND OF THE INVENTION

1. Field of the invention

This invention relates in general to battering rams, and in particular to a battering ram that has a pointed end and movable barbs for piercing a door to pull outward on the door.

2. Description of the Prior Art

Law enforcement officers must forcibly enter premises on occasion. For example, law enforcement officers may on the basis of a warrant have a need to forcibly enter a suspected illegal drug laboratory. Often, the occupants of the building are either not there or will not open the door. A need exists for quickly opening the door to utilize the element of surprise before the occupants could destroy valuable evidence.

Battering rams have been used for centuries to knock down doors. Typically, a battering ram has a heavy elongated body and a flat head on one end. Users will swing the head against the door to break it down or cause it to swing open. Many buildings, particularly mobile homes, however, have doors which swing outward, rather than open inward. If the door is a metal door, it may be difficult to open the door with a battering ram because the ram would be pushing against the door frame.

SUMMARY OF THE INVENTION

In this invention, a battering ram is provided with one end that is pointed. The pointed end or head has a conical tip. A pair of barbs extend rearward from the conical tip. The barbs will swing between a collapsed and expanded position. A spring urges the rearward ends of the barbs outward.

When the battering ram is swung against the door, the tip and the barbs will pierce the door. Once pierced, the barbs will spring outward to a diameter greater than the opening in the doorway. Law enforcement officers will then swing the ram rearward. The rearward ends of the barbs will catch against the door. This hooks the door and enables the door to be pulled outward.

For a combination of battering and pulling, one end of the battering ram may contain a battering plate. In addition, the user may secure a loop on the end opposite the pointed end. A line may be attached from a vehicle to the loop to pull the battering ram rearward once it is hooked into the door. Furthermore, a lateral bar can be located on one end of the battering ram. The bar will locate between burglar bars to enable law enforcement officers to pull the burglar bars from the opening if needed.

DETAILED DESCRIPTION OF THE INVENTION

Figure 1:
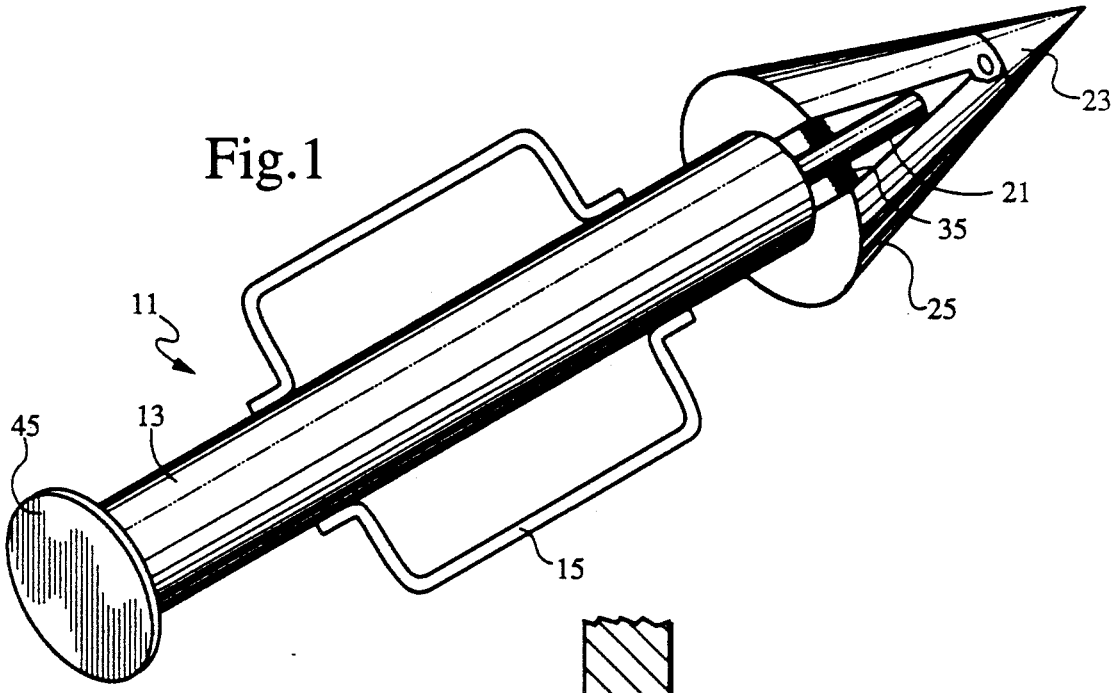
FIG. 1 is a perspective view illustrating a preferred embodiment of a battering ram constructed in accordance with this invention.
Figure 2:
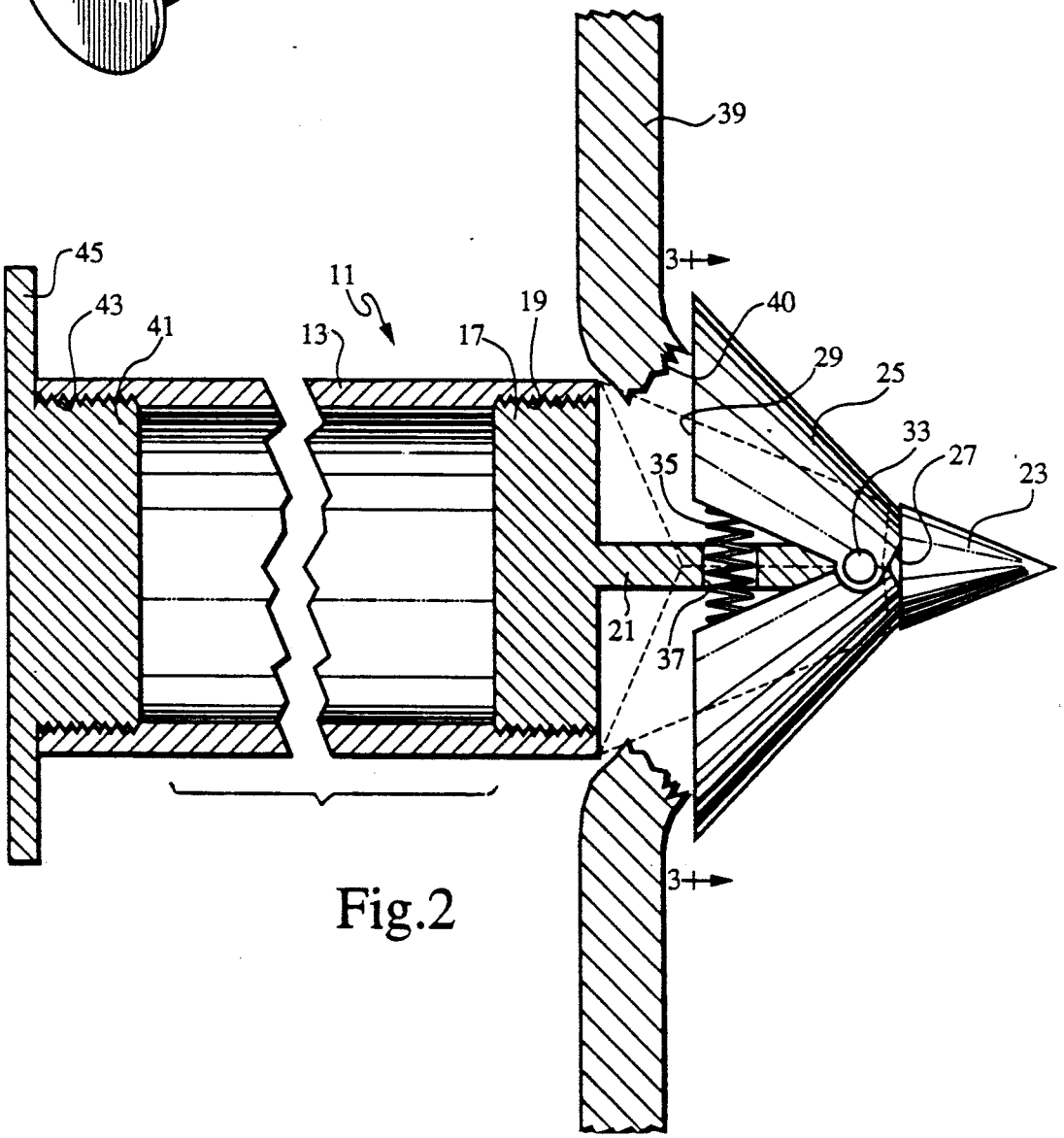
FIG. 2 is a vertical sectional view of a portion of the battering ram of FIG. 1.

Referring to FIG. 1, battering ram 11 has an elongated tubular body 13. Two handles 15 are welded to opposite sides of the body 13. As shown in FIG. 2, a head plate 17 secures to threads 19 located at the forward end of body 13. Head plate 17 is a metal plate. A shaft 21 is welded to the forward side of head plate 17. Shaft 21 extends forward coaxially with the longitudinal axis of body 13. Shaft 21 is of considerably smaller diameter than the diameter of body 13.

Figure 3:
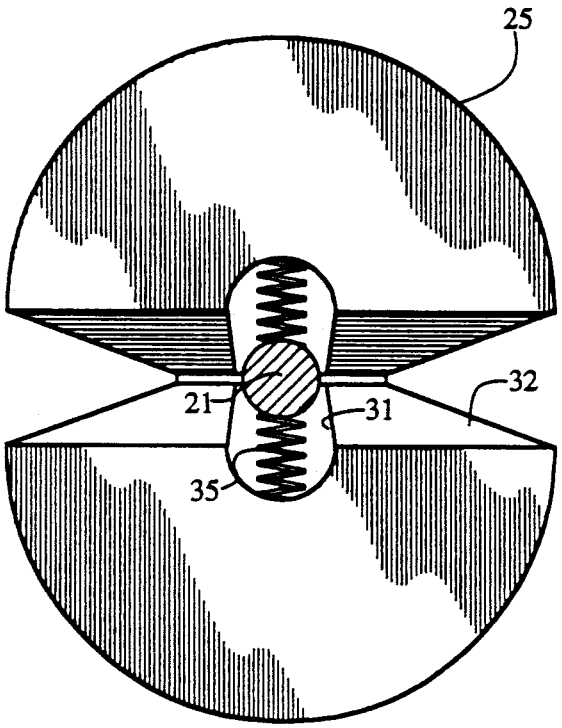
FIG. 3 is a sectional view of a portion of the battering ram of FIG. 1, taken along the line III—III of FIG. 2.

A conical tip 23 is rigidly mounted to the forward end of shaft 21. Tip 23 has a sharp point on its forward end. A pair of barbs 25 extend rearward from tip 23. Each barb 25 comprises approximately one-half of a cone. The forward end 27 of each barb 25 is truncated. The rearward end 29 of each barb 25 is a flat surface. As shown in FIG. 3, an axial recess 31 extends along the inside surface 32 of each barb 25. The recesses 31 are each semi-cylindrical to accommodate the shaft 21.

Each barb 25 is pivotally mounted to shaft 21 at its forward end 27 by a single pivot pin 33. Pivot pin 33 allows each barb 25 to swing its rearward end 29 laterally outward relative to shaft 21. The dotted lines in FIG. 2 illustrate a contracted position, while the solid lines show the barbs 25 in an expanded position. The forward ends 27 of the barbs 25 are inclined so as to allow the barbs 25 to move to the expanded position without interfering with the rearward end of the tip 23.

When in the expanded position, the rearward ends 29 will be in a plane perpendicular to the axis of shaft 21. When in the expanded position shown in FIG. 2, the outer edges of the rearward ends 29 will extend a significant distance radially or laterally outward past the body 13. When in the expanded position, a substantial clearance exists between the rearward end 29 of each barb 25 and the forward side of the head plate 17. This clearance preferably is at least equal to the width of most metal doors 39.

When in the contracted position, shown by the dotted lines, the barbs 25 will define a conical surface that is at the same degree of taper as the tip 23. The diameter of the rearward end of tip 23 equals the combined diameter of the forward ends 27 of the barbs 25 when contracted. Also, the rearward ends 29 will contract to substantially the same outer diameter as the body 13. The outer edges of the rearward ends 29 will be almost touching the forward end of the body 13 when in the contracted position.

Spring means comprising a spring 35 urges the barbs 25 laterally apart to the expanded position. Spring 35 is a coil spring that extends through a hole 37 in shaft 21. Hole 37 is perpendicular to shaft 21. Spring 35 has one end extended into a hole (not shown) in each of the barbs 25.

Referring still to FIG. 2, an end plate 41 secures to internal threads 43 in the rearward end of body 13. The threads 43 are the same diameter and size as the threads 19 to enable the plates 17, 41 to interchangeably be placed at either end. A battering plate 45 is formed on the end plate 41. Battering plate 45 is a circular plate that extends radially outward from body 13, having a larger diameter than body 13.

In the operation of the embodiment of FIGS. 1-3, the users may utilize either the tip 23 or the battering plate 45. If the battering plate 45 is utilized, the body 13 will be swung against door 39. If the door 39 is an inward opening door and is to be opened by pulling rearward, the tip 23 should be used. The users will swing the battering ram 11 against the door with sufficient force to cause the tip 23 to pierce the door 39. The body 13 will move forward, with the barbs 25 passing through the pierced opening 40 in the door 39. A portion of the body 13 may also extend through the pierced opening 40. When the barbs 25 are passing through the pierced opening 40, they will contract to the position shown by the dotted lines. This facilitates entry of the barbs 25 through the pierced opening 40.

Once the barbs 25 have cleared the pierced opening 40, they will spring outward to the expanded position shown in FIG. 2. The users then swing rearward on the battering ram 11. The rearward ends 29 will contact the inside surface of door 39. This hooks door 39, causing an outward pull to be exerted on door 39. If sufficient force is applied, the locking mechanism of door 39 will shear, allowing door 39 to open.

Figure 5:
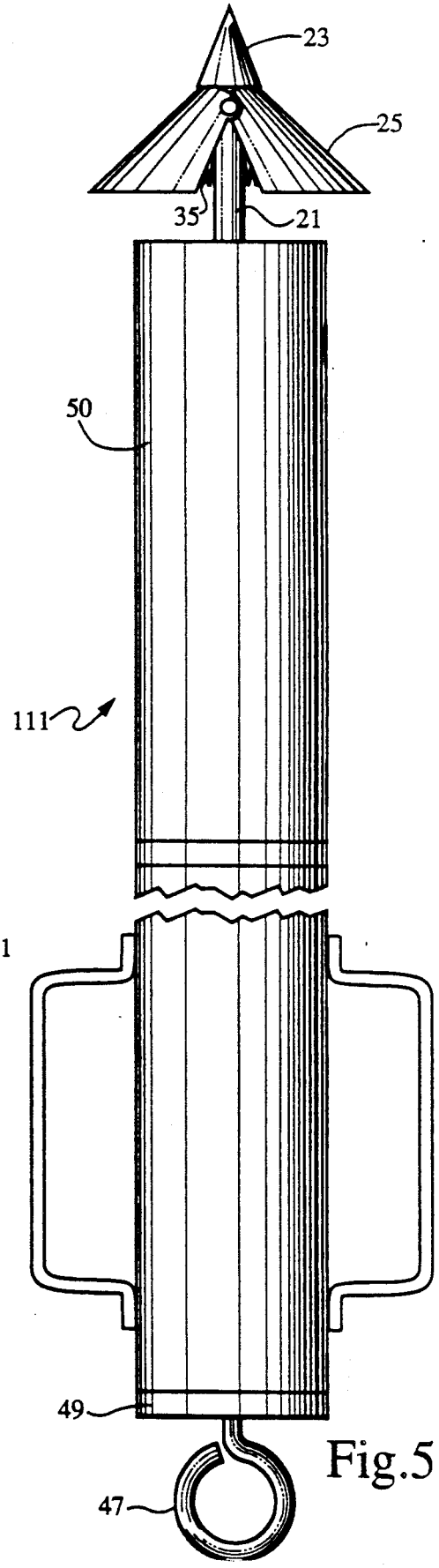
FIG. 5 is a second alternate embodiment of the battering ram of this invention, showing the battering ram of FIG. 1 with a loop on one end rather than a battering plate.

In the embodiment of FIG. 5, the battering ram 111 is the same as in FIGS. 1-3, except for two differences. One difference is the use of an extension sub 50. Extension sub 50 lengthens the body 13 if desired. Another difference is the use of a loop 47 rather than a battering plate 45 (FIG. 2). Loop 47 may be a hook or eyelet. It is welded or secured to an end plate 49 that screws in the rearward end of the battering ram 111. The law enforcement officers may tie a line to the loop 47. The other end of the line may be connected to a vehicle so that the power of the vehicle can be used to pull a door outward once the door has been hooked by the battering ram 111 as previously described.

Figure 4:
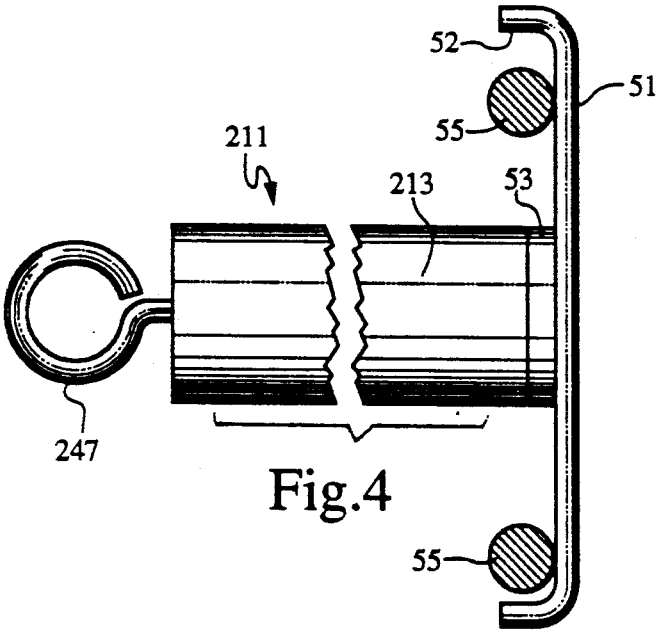
FIG. 4 is an alternate embodiment of the battering ram of FIG. 1, showing the body of the battering ram of FIG. 1 having a loop secured at one end and a lateral bar secured to the other end for removing burglar bars.

In the embodiment of FIG. 4, a bar 51 will be connected to one of the ends of the battering ram tool 211. Bar 51 extends laterally from the batting ram 211. The bar 51 has ends 52 which are parallel to the axis of the body 213 and perpendicular to the bar 51. The bar 51 secures to a plate 53 which screws into the body 213 at one end or the other.

In the operation of the embodiment of FIG. 4, the user will rotate the bar 51 so that it is parallel with the burglar bars 55 and insert the bar 51 behind the burglar bars 55. The user then will rotate the body 213 until the bar 51 hooks inside at least two of the burglar bars 55. A loop 247 may be located on the opposite end of body 213 for attachment to a line leading to a vehicle. Pulling on the battering ram 211 will pull the bars 55 from the doorway if sufficient force is applied.

The invention has significant advantages. The battering ram can be used to forcibly open a door that opens outward. The movable barbs facilitate the hooking of the door for the outward pull.

While the invention has been shown in only three of its forms, it should be apparent to those skilled in the art that it is not so limited, but is susceptible to various changes without departing from the scope of the invention.

I claim:

1. A battering ram for forcible entry through a door, comprising in combination:

an elongated body;

a pair of barbs carried by the body, extending rearward and laterally outward; and spring means for biasing the barbs apart from each other, so that the barbs will contract when piercing the door, and expand outward once the door is pierced, hooking the door with the battering ram to enable the door to be pulled in a rearward direction with the battering ram.

2. The battering ram according to claim 1 wherein the barbs will swing laterally inward and outward relative to each other about a pivot point located on forward ends of the barbs.

3. The battering ram according to claim 1 wherein the barbs define a conical surface when contracted.

4. The battering ram according to claim 1 further comprising a pointed tip carried by the body forward of the barbs, the barbs being moveable relative to the tip.

5. The battering ram according to claim 1 further comprising:

a conical tip carried by the body forward of the barbs;

wherein the barbs will swing laterally inward and outward relative to each other about a pivot point located on forward ends of the barbs; and wherein the barbs define a conical surface having the same taper as the tip when the barbs are contracted.

6. The battering ram according to claim 1 wherein the barbs are carried by a shaft that extends forward from the body.

7. The battering ram according to claim 1 further comprising a flat battering plate mounted to the body on an end opposite the barbs, to enable the battering ram to be used to batter the door.

8. The battering ram according to claim 1 further comprising a loop mounted to the body on an end opposite the barbs, to enable a line to be connected between the loop and a vehicle to pull the battering ram rearward once the barbs and tip have pierced the door.

9. The battering ram according to claim 1 further comprising a lateral bar mounted to the body on an end opposite the barbs, and extending laterally in opposite directions from the body, the bar enabling the battering ram to be hooked into burglar bars for pulling the burglar bars loose.

10. A battering ram for forcible entry through a door, comprising in combination:

an elongated body having a forward end, a rearward end, and a longitudinal axis;

a shaft extending from the forward end coaxial with the axis of the body;

a pointed tip mounted to a forward end of the shaft;

a pair of barbs having forward and rearward ends, the forward ends of the barbs being mounted to the shaft by a pivot pin located rearward of the tip, the barbs being movable about the pivot pin from a contracted position to an expanded position in which the rearward ends of the barbs expand laterally apart from each other; and spring means for biasing the barbs to the expanded position, so that the barbs will move to the expanded position once the door is pierced, hooking the door with the battering ram to enable the door to be pulled in a rearward direction with the battering ram.

11. The battering ram according to claim 10 wherein the spring means comprises a coil spring extending between the barbs transverse to the shaft.

12. The battering ram according to claim 10 wherein the body is of larger diameter than the shaft, and wherein an annular space exists between the rearward ends of the barbs and the forward end of the body when the barbs are in the expanded position.

13. The battering ram according to claim 10 wherein the tip is conical, and wherein the barbs define a conical surface having the same taper as the tip when the barbs are contracted.

14. A battering ram for forcible entry through a door, comprising in combination:

an elongated tubular body having a forward end, a rearward end and a longitudinal axis;

a least one handle mounted to the body for grasping by a user;

a head plate secured by threads to the forward end of the body;

an end plate secured by threads to the rearward end of the body;

a shaft secured to and extending forward from the head plate coaxial with the axis of the body;

a pointed tip mounted to a forward end of the shaft;

a pair of barbs having forward and rearward ends, the forward ends of the barbs being mounted to the shaft by a pivot pin located rearward of the tip, the barbs being movable about the pivot pin from a contracted position to an expanded position in which the rearward ends of the barbs expand laterally apart from each other, the rearward ends of the barbs being spaced forward of the head plate; and spring means for biasing the barbs to the expanded position, so that the barbs will move to the expanded position once the door is pierced, hooking the door with the battering ram to enable the door to be pulled in a rearward direction with the battering ram.

15. The battering ram according to claim 14 wherein the distance between outer edges of the barbs when in the contracted position is substantially the same as the diameter of the body.

16. The battering ram according to claim 14 further comprising a flat battering plate mounted to the end plate to enable the battering ram to be used to batter the door.

17. The battering ram according to claim 14 further comprising a loop mounted to the end plate to enable a line to be connected between the loop and a vehicle to pull the battering ram rearward once the barbs and tip have pierced the door.

18. The battering ram according to claim 14 further comprising a lateral bar mounted to the end plate and extending laterally in opposite directions from the body, the bar enabling the battering ram to be hooked into burglar bars for pulling the burglar bars loose.

19. The battering ram according to claim 14 wherein the tip is conical, and wherein each of the barbs is a partial cone, the barbs combining to define a conical surface when the barbs are in the contracted position with the same taper as the tip.

20. A method of forcibly opening a door, comprising in combination:

providing a battering ram with a pair of barbs, extending rearward and laterally outward from a body;

biasing the barbs apart from each other;

ramming the battering ram against the door, piercing the door and causing the barbs to contract when piercing the door, and expand outward once the door is pierced to hook the door; then pulling the battering ram in a rearward direction, with the barbs contacting the door and causing the door to move in a rearward direction with the battering ram.

* * * * *